US008091888B2

(12) United States Patent
Tamamoto

(10) Patent No.: US 8,091,888 B2
(45) Date of Patent: Jan. 10, 2012

(54) SHEET HANDLING APPARATUS

(75) Inventor: Junichi Tamamoto, Chiyoda (JP)

(73) Assignee: Hitachi-Omron Terminal Solutions Corp., Tokyo (JP)

( * ) Notice: Subject to any disclaimer, the term of this patent is extended or adjusted under 35 U.S.C. 154(b) by 0 days.

(21) Appl. No.: 10/772,386

(22) Filed: Feb. 6, 2004

(65) Prior Publication Data

US 2004/0262836 A1 Dec. 30, 2004

(30) Foreign Application Priority Data

Jun. 24, 2003 (JP) ..... 2003-178859

(51) Int. Cl.
*B65H 5/00* (2006.01)
*B65H 7/02* (2006.01)

(52) U.S. Cl. ... 271/264; 271/259; 271/262; 271/265.02; 271/265.04; 271/2; 271/227; 271/242; 271/244; 271/122; 355/282; 355/271; 400/642; 209/534; 198/624

(58) Field of Classification Search ..... 271/264, 271/271, 188, 265.02, 209, 259.09, 273, 271/262, 265.04, 2, 227, 242, 244, 122, 259; 209/534; 198/624; 160/135; 355/282, 271; 400/642
See application file for complete search history.

(56) References Cited

U.S. PATENT DOCUMENTS 3,276,425 A * 10/1966 Rabb ..... 399/322
3,966,047 A * 6/1976 Steiner ..... 209/534
4,015,730 A * 4/1977 Symmank ..... 414/718
4,280,036 A * 7/1981 Fukatsu ..... 235/379
4,567,349 A * 1/1986 Henry et al. ..... 219/216
4,837,064 A * 6/1989 Tschudin-Mahrer ..... 428/71
4,993,700 A * 2/1991 Winkler ..... 271/186
5,245,897 A * 9/1993 Arnold et al. ..... 83/56
5,397,003 A * 3/1995 Stevens et al. ..... 209/534
5,486,063 A * 1/1996 Fox et al. ..... 400/708
5,764,346 A 6/1998 Jard et al.
5,809,885 A * 9/1998 Koch et al. ..... 101/232
(Continued)

FOREIGN PATENT DOCUMENTS

EP 0 718 809 A2 6/1996
(Continued)

OTHER PUBLICATIONS

European Search Report dated Nov. 24, 2005.

*Primary Examiner* — Gene O. Crawford
*Assistant Examiner* — Rakesh Kumar
(74) *Attorney, Agent, or Firm* — Antonelli, Terry, Stout & Kraus, LLP

(57) ABSTRACT

In an apparatus for handling sheets, first and second sheet transfer members are movable to transfer one of the sheets between the first and second sheet transfer members, the first and second sheet transfer members have respective transfer surfaces contactable with the one of the sheets so that the one of the sheets is driven to be transferred by at least one of the first and second sheet transfer members, and an information reader is arranged between the first and second sheet transfer members in such a manner that an information is readable from the one of the sheets even when the one of the sheets is transferred by one of the first and second sheet transfer members and is prevented from being transferred by both of the first and second sheet transfer members.

19 Claims, 8 Drawing Sheets

U.S. PATENT DOCUMENTS

| | | | | |
|---|---|---|---|---|
| 5,934,140 | A * | 8/1999 | Jackson et al. | 73/159 |
| 6,073,744 | A * | 6/2000 | Raterman et al. | 194/207 |
| 6,311,819 | B1 * | 11/2001 | Stromme et al. | 194/207 |
| 6,418,358 | B1 * | 7/2002 | Armanini et al. | 700/225 |
| 6,668,155 | B1 * | 12/2003 | Hubble et al. | 399/406 |
| 7,153,861 | B2 * | 12/2006 | Leach et al. | 514/258.1 |
| 7,296,795 | B2 * | 11/2007 | Kawasaki | 271/262 |
| 2002/0060421 | A1 * | 5/2002 | Kako et al. | 271/259 |
| 2004/0080102 | A1 * | 4/2004 | Hachimann et al. | 271/264 |
| 2004/0123757 | A1 * | 7/2004 | Conzelmann et al. | 101/230 |

FOREIGN PATENT DOCUMENTS

| | | |
|---|---|---|
| EP | 1 199 681 A2 | 8/2001 |
| JP | 2000-90318 | 3/2000 |
| JP | 2000-259885 | 9/2000 |

* cited by examiner

SHEET HANDLING APPARATUS

BACKGROUND OF THE INVENTION

The present invention relates to an apparatus for handling sheets (for example paper sheets such as paper moneys) in which the sheets as thin mediums are transferred, and an information is obtained from the mediums.

In relation to a sheet transferring device including a prior art information obtaining function, a sheet discrimination device as disclosed by JP-A-2000-259885 exists.

In this prior art, a structure for discriminating a surface condition of the sheet is shown, and a paper money is pressed between rollers at front and back sides of a detecting unit to be transferred.

Further, in JP-A-2000-90318, a method for discriminating the sheet is disclosed, and a coupon ticket, voting card or the like is pressed between the rollers at front and back sides of an image sensor to be transferred.

BRIEF SUMMARY OF THE INVENTION

An object of the present invention is to provide an apparatus for handling sheets, in which apparatus an information is correctly readable from one of the sheets.

According to the invention, since an apparatus for handling sheets, comprises, a sheet transfer member being movable, and having a transfer surface contactable with one of the sheets so that the one of the sheets is transferred by the sheet transfer member, a sheet supporting surface area being contactable with the one of the sheet transferred by the sheet transfer member, and an information reader arranged to face to the one of the sheet transferred by the sheet transfer member and having in an information reading range including an information reading point (any point in the information reading range, and the information is read from the one of the sheets existing at the information reading point), in which reading range an information is securely readable from the one of the sheets, the information is correctly readable from the one of the sheets supported by the sheet supporting surface area.

If the sheet supporting surface area extends to be contactable with a part of the one of the sheet extending between the transfer surface and the information reading point (so that the information is readable from the one of the sheets supported by the sheet supporting point and the transfer surface, an front end of the one of the sheets transferred by the sheet transfer member is supported by the sheet supporting surface area, and/or the one of the sheets transferred by the sheet transfer member is guided to the information reading range along the sheet supporting surface area), the one of the sheets supported by the sheet supporting surface area is correctly positioned in the information reading range so that the information is securely read from the one of the sheets.

If the sheet supporting surface area extends to guide therealong to the information reading range the one of the sheets transferred by the sheet transfer member, the one of the sheets is securely introduced in the information reading range.

If as seen in a view direction perpendicular to a thickness direction of the one of the sheets and a transferred direction of the one of the sheets transferred by the sheet transfer member (that is, in a direction perpendicular to a surface of the drawings of the present application), a (imaginary) tangential line of a boundary point of the transfer surface of the sheet transfer member from which boundary point the one of the sheets starts to separate away from the transfer surface extends in a side area of an imaginary straight line passing the information reading point and the boundary point, which side area including the sheet supporting surface area (and is prevented from extending the other area of the imaginary straight line, which other area is prevented from including the sheet supporting surface area), the one of the sheets is securely directed toward the sheet supporting surface area.

If the tangential line intersects the sheet supporting surface area as seen in the view direction (between the transfer surface and the information reading point so that at least a part of, particularly the front end of the one of the sheets transferred by the sheet transfer member is directed toward the sheet supporting surface area), the one of the sheets is securely directed toward the sheet supporting surface area to be supported by the sheet supporting surface area.

It is preferable for the one of the sheets is securely guided toward the sheet supporting surface area that the tangential line is prevented from extending parallel to the imaginary straight line.

If the apparatus further comprises a supplemental sheet transfer member being movable, and having a supplemental transfer surface contactable with the one of the sheets so that the one of the sheets is transferred by the supplemental sheet transfer member, wherein a (imaginary) tangential line of a boundary point of the transfer surface of the sheet transfer member from which boundary point the one of the sheets starts to separate away from the transfer surface of the sheet transfer members intersects with a (imaginary) tangential line of a boundary point of the supplemental transfer surface of the supplemental sheet transfer member from which boundary point the one of the sheets starts to separate away from the supplemental transfer surface of the supplemental sheet transfer member as seen in the view direction, the one of the sheets is securely bent in only one direction parallel to the thickness direction of the one of the sheets so that a positional relationship between the one of the sheets and the information reader is stably kept.

If the apparatus further comprises a supplemental sheet transfer member being movable and having a supplemental transfer surface contactable with the one of the sheets so that the one of the sheets is transferred by the supplemental sheet transfer member, and first and second sheet press members being opposed to the sheet transfer member and supplemental sheet transfer member respectively in such a manner that the one of the sheets is allowed to be pressed between the sheet transfer member and the first sheet press member in a first press direction and between the supplemental sheet transfer member and the second sheet press member in a second press direction, wherein the first and second press directions intersect with each other as seen in the view direction, the one of the sheets is securely bent in only one direction parallel to the thickness direction of the one of the sheets so that a positional relationship between the one of the sheets and the information reader is stably kept.

If the apparatus further comprises a sheet press member being opposed to the sheet transfer member in such a manner that the one of the sheets is allowed to be pressed between the sheet transfer member and the sheet press member at a boundary point in a press direction, wherein an imaginary straight line passing the boundary point in a direction perpendicular to the press direction intersects the sheet supporting surface area as seen in the view direction, at least a part of, particularly the front end of the one of the sheets transferred by the sheet transfer member is directed toward the sheet supporting surface area so that the one of the sheets is supported by the sheet supporting surface area.

If the apparatus further comprises a sheet press member being opposed to the sheet transfer member in such a manner that the one of the sheets is allowed to be pressed between the sheet transfer member and the sheet press member, wherein the sheet press member has a press surface contactable with the one of the sheets so that the one of the sheets is pressed between the press and transfer surfaces, and a compression resistance surface rigidity of one of the press and transfer surfaces is different from that of the other one of the press and transfer surfaces in such a manner that a tangential line of a boundary point of at least one of the press and transfer surfaces from which boundary point the one of the sheets starts to separate away from the at least one of the press and transfer surfaces extends in the side area of the imaginary straight line, the one of the sheets is securely directed toward the sheet supporting surface area.

The sheet transfer member may be a roller rotatable on an rotational axis, and/or a belt rotatable along an annular course.

If the apparatus further comprises a pneumatic blower for applying a pneumatic pressure to the one of the sheets in such a manner that the one of the sheets is urged by the pneumatic pressure toward the sheet supporting surface area, the one of the sheets is securely directed toward the sheet supporting surface area to be supported thereon.

The information reader may have a pair of input points opposed to each other in such a manner that the input points face to respective sides of the one of the sheet in a thickness direction of the one of the sheets to read the information through the input points.

It is preferable for restraining an undesirable jam or crease of the one of the sheets that as seen in the view direction, when the sheet supporting surface area extends straightly in parallel to a support line direction and passes the information reading range, $\alpha$ is an inclination angle between the support line direction and a (imaginary) tangential line of the boundary point of the transfer surface of the sheet transfer member, L is a distance between the boundary point of the transfer surface of the sheet transfer member and the information reading point (any point in the information reading range) in the support line direction, h is a distance between the boundary point of the transfer surface of the sheet transfer member and the sheet supporting surface area in a direction perpendicular to the support line direction, and μpg is a frictional coefficient between the one of the sheets and the transfer surface of the sheet transfer member, $\tan^{-1}(h/L)<\alpha<\tan^{-1}(1/\mu_{pg})$.

It is preferable for restraining an undesirable jam or crease of the one of the sheets that as seen in the view direction, when the sheet supporting surface area extends straightly in parallel to a support line direction and passes the information reading range, $\alpha$ is an inclination angle between the support line direction and a (imaginary) tangential line of the boundary point of the transfer surface of the sheet transfer member, L is a distance between the boundary point of the transfer surface of the sheet transfer member and the information reading point (any point in the information reading range) in the support line direction, h is a distance between the boundary point of the transfer surface of the sheet transfer member and the sheet supporting surface area in a direction perpendicular to the support line direction, μpg is a frictional coefficient between the one of the sheets and the transfer surface of the sheet transfer member, and J is a distance in the direction perpendicular to the support line direction between the boundary point and an intersecting point between an imaginary line passing the information reading point (any point in the information reading range) and extending perpendicular to the support line direction and an imaginary line passing the boundary point of the transfer surface of the sheet transfer member and extending perpendicular to the tangential line of the boundary point of the transfer surface of the sheet transfer member, $J<(L^2/h)$, and $\alpha<\tan^{-1}(1/\mu_{pg})$.

If the apparatus further comprises a supplemental sheet supporting surface area opposed to the sheet supporting surface area, contactable with the one of the sheets, and movable with respect to the sheet supporting surface area in such a manner that the one of the sheets contacting the supplemental sheet supporting surface area and transferred by the sheet transfer member is urged in a direction (away from the sheet transfer member and) toward the sheet supporting surface area, the one of the sheets is securely directed toward the sheet supporting surface area to be supported thereon. Further, if the supplemental sheet supporting surface area is opposed to the information reading range (in a thickness direction of the one of the sheets in the information reading range so that the one of the sheets contacting the supplemental sheet supporting surface area and transferred by the sheet transfer member is urged toward the information reading range), the positional relationship between the one of the sheets and the information reader is stably kept.

If the apparatus further comprises a (may be stationary) supplemental sheet supporting surface area being opposed to the sheet supporting surface area and contactable with the one of the sheets, and extending in such a manner that the one of the sheets contacting the supplemental sheet supporting surface area and transferred by the sheet transfer member is guided toward the sheet supporting surface area, the one of the sheets is securely directed toward the sheet supporting surface area to be supported thereon.

The sheet supporting surface area may be curved (so that the tangential line of the boundary point of the supplemental transfer surface of the supplemental sheet transfer member from which boundary point the one of the sheets starts to separate away from the supplemental transfer surface of the supplemental sheet transfer member intersects the sheet supporting surface area, and/or a tangential line of the sheet supporting surface area is prevented from being perpendicular to a direction in which the one of the sheet is pressed against the transfer surface).

If the apparatus further comprises a distance detector arranged to face to the one of the sheets so that a value changing in accordance with a change in distance between the one of the sheets and the information reader is measured by the distance detector, wherein the information reader includes a light emitter for projecting a light to the one of the sheets and a light receiver for receiving the light reflected by the one of the sheets to read the information from the one of the sheets, and the light emitter is controlled in accordance with the value in such a manner that an intensity of the light emitted by the light emitter is increased in accordance with the increase of distance between the one of the sheets and the information reader.

Other objects, features and advantages of the invention will become apparent from the following description of the embodiments of the invention taken in conjunction with the accompanying drawings.

DETAILED DESCRIPTION OF THE INVENTION

An embodiment of the invention applied to an automated teller machine (ATM) is described below.

Figure 1:
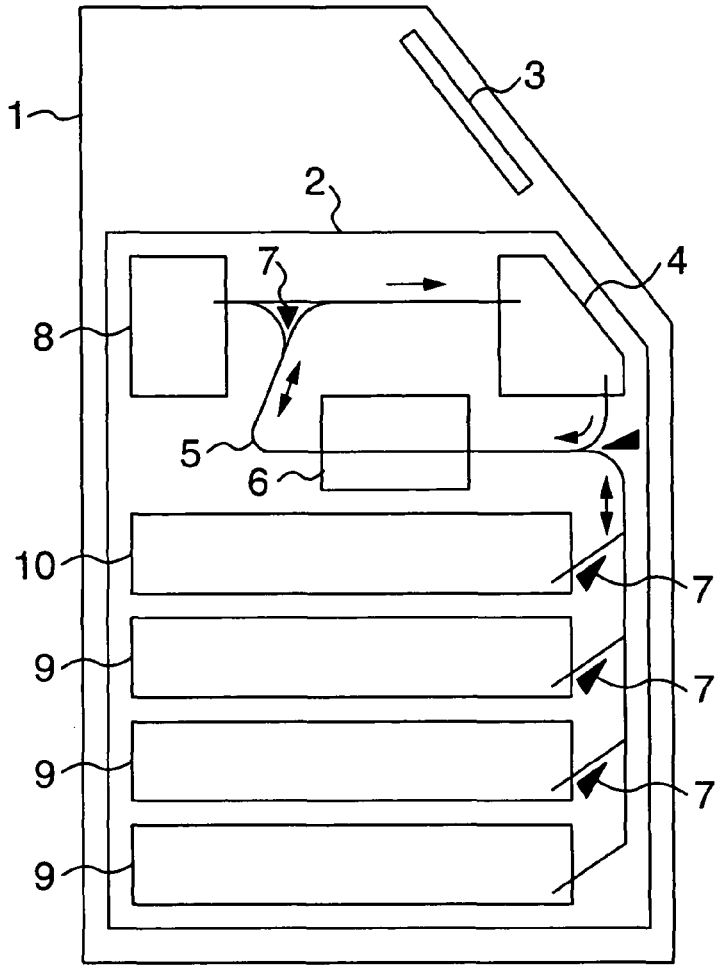
FIG. 1 is a schematic view of an automated teller machine.

FIG. 1 is a schematic view showing an example of an automated teller machine (ATM) 1 of the invention.

In FIG. 1, the ATM has a plurality of modules, and a paper money handling device 2 and an input and output device 3 are shown in FIG. 1. The paper money handling device 2 performs a treatment of handling paper moneys, for example, receiving and disbursing the paper money. Detailed structure and operation thereof will be described below. The input and output device 3 is, for example, a combination of a monitor and push-buttons, or a touch panel in which the monitor and push-buttons are combined. By the input and output device 3, an operator of the ATM 1 inputs selected one of receiving and disbursing the money, or an operating sequence is indicated to an operator of the ATM 1. In addition, it may have a module for handling a card, a module for handling a passbook or a module for handling coins.

When the paper money is received, the operator selects a receiving money treatment on the input and output device 3. A shutter of a money receiving and disbursing port 4 is opened so that a bundle of the paper moneys is taken in. The receiving and disbursing money port 4 draws out the paper moneys one by one with a drawing roller including a rubber periphery to be transferred to a transfer passage 5. The transfer passage 5 has, for example, a belt or roller to clamp the paper money so that the paper money is transferred by a movement or rotation of the belt or roller. An optical or magnetic characteristic of the transferred paper money is measured by a checking device 6 to determine whether or not the paper money is counterfeit.

The paper money which was deemed to be counterfeit or broken so that the paper money is not appropriate for being used, is returned to the by switching a gate 7.

On the other hand, the paper money which was deemed to be appropriate for being used, is contained temporarily in a temporary storage portion 8. After a confirmation of amount of money is performed between the operator and the input and output device 3, the paper money is drawn out of the temporary storage portion 8 to be transferred to a storage portion 9 through the transfer passage 5. When a plurality of the storage portions 9 are arranged, the storage portions 9 contain, for example, respective kinds of the paper moneys by switching the gate 7.

When the paper money is disbursed, the operator selects disbursing the money on the input and output device 3. The storage portion 9 draws out an ordered number of the paper moneys to be transferred to the transfer passage 5. If the paper money is deemed to be inappropriate for being disbursed when the paper money passes the checking device 6, the paper money is contained in the temporary storage portion 8 by switching the gate 7. Appropriate one of the paper moneys is received by the receiving and disbursing money port 4. After containing a predetermined number of the paper moneys, the shutter of the receiving and disbursing money port 4 is opened to be taken out by the operator. The inappropriate one B of the paper moneys is drawn out of the temporary storage portion 8 to be contained in a reject strage portion 10.

The ATM 1 performs receiving and disbursing the money along the above operations. In this ATM 1, the present invention is applicable to the checking device 6 for obtaining an information of the paper money such as an optical image or magnetic pattern thereof.

Figure 2:
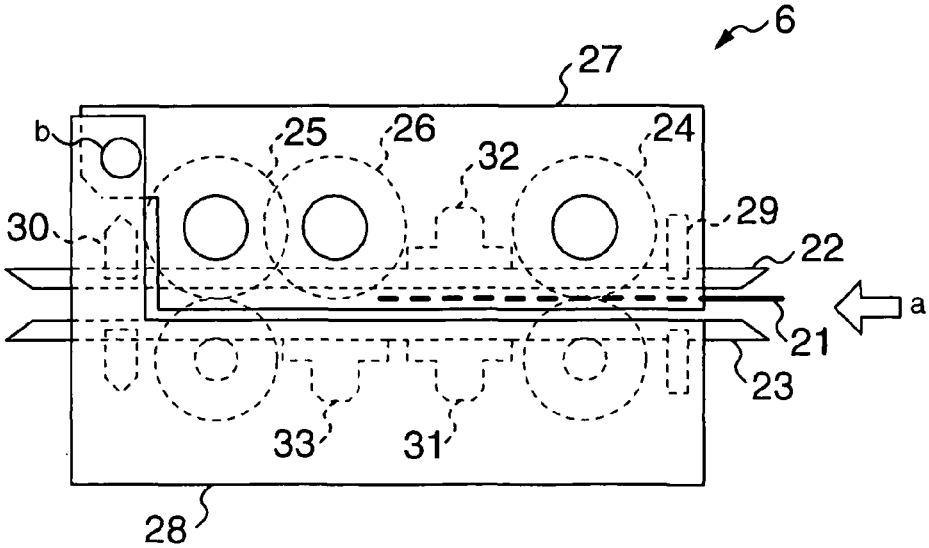
FIG. 2 is a schematic view of a discriminating part.
Figure 3:
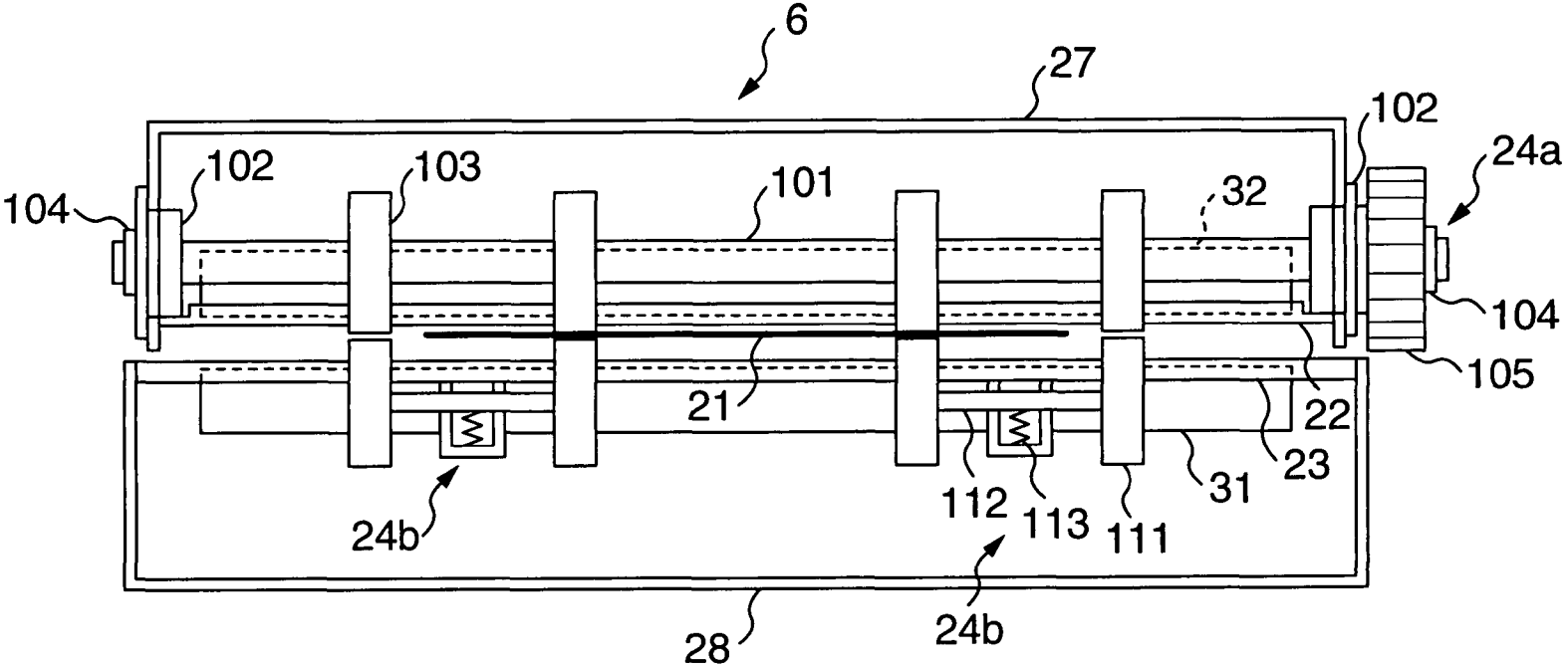
FIG. 3 is a schematic view of a discriminating part.

FIGS. 2 and 3 shows a structure of the checking device 6. FIG. 2 shows the structure as seen in a side of a paper money transferring direction, and FIG. 3 shows the structure as seen in a direction of arrow a of the paper money transferring direction.

In FIGS. 2 and 3, a paper money 21 is transferred in a transfer clearance between first and second guide device 22 and 23 by first and second transfer device 24 and 25. A movable guide device 26 (whose outer peripheral surface is as the claimed supplemental sheet supporting surface area) projects into the transfer clearance to transfer the paper money 21 and guide the paper money 21 in a predetermined direction.

The first and second guide device 22 and 23 are formed by, for example, a sheet of metal or resin, and fixed with a predetermined distance therebetween.

The first and second transfer device 24 and 25 are, for example, a pair of rollers pressed against each other. Concrete structure thereof is shown in FIG. 3. The first transfer device 24 has a drive roller 24*a* and a driven roller 24*b*. The drive roller has a shaft 101, a bearing 102 for supporting the shaft 101 in a rotatable manner, a rubber roller 103, a stop ring 104 for fixing the shaft axially, and a gear 103 for transmitting a drive force. The driven roller 24*b* has a bearing 111 with an outer ring used for transfer, a shaft 112 for supporting the bearing 111, and a spring 113 with an end fixed to the second guide device 23 to urge the shaft 112.

The drive roller 24*a* is rotated by the drive force of a motor (not shown) through the gear 105. The driven roller 24*b* is pressed against the drive roller 24*a* by the spring 113. Therefore, the paper money 21 is clamped between the drive and driven rollers 24*a* and 24*b* to be driven by the drive force applied from the rubber roller 103.

The movable guide device 26 has the same structure as the drive roller 24*a* of the first drive device, and is arranged with a clearance or contact with respect to the second guide device opposed to it. The roller of the movable guide device 26 is rotated to generate the drive force in the transfer direction. Therefore, a clearance between the movable guide device 26 and the second guide device 23 may be smaller than a clearance between the first and second guide device 22 and 23 so that the paper money can approach close an information obtaining device 33.

First and second casings 27 and 28 support the first and second guide device 22 and 23, first and second transfer device 24 and 25 and the movable guide device 26 to form an outer periphery of the checking device 6. The first and second casings 27 and 28 are supported in a rotatable manner on a fulcrum b so that the transfer clearance can be opened for maintenance.

First and second pass detecting device 29 and 30 are respective pairs of photodiodes and phototransistors so that the paper money moving into the checking device 6 is detected on intercept of an optical beam axis by the paper money.

First, second and third information obtaining device 31, 32 and 33 are arranged close to the transfer clearance to obtain the optical or magnetic information of the paper money 21. The first and second information obtaining device 31 and 32 are, for example, optical information obtaining device in which a light emitter of light emitting diode irradiates the paper money and a reflection thereof is detected by an optical receiver to obtain an image of the paper money 21. By the first and second information obtaining device 31 and 32 opposed to each other through the transfer clearance, optical images of both sides of the paper money are obtainable simultaneously.

The third information obtaining device 33 is, for example, a magnetic information obtaining device in which a pattern of magnetic field magnitude of the paper money is obtainable.

In the ATM 1, since the paper money as valuable resource is handled, a significantly high reliability on detecting a kind of the paper money and checking a bad paper is required. Therefore, in the checking device 6, the information of the paper money needs to be obtained correctly.

Figure 4:
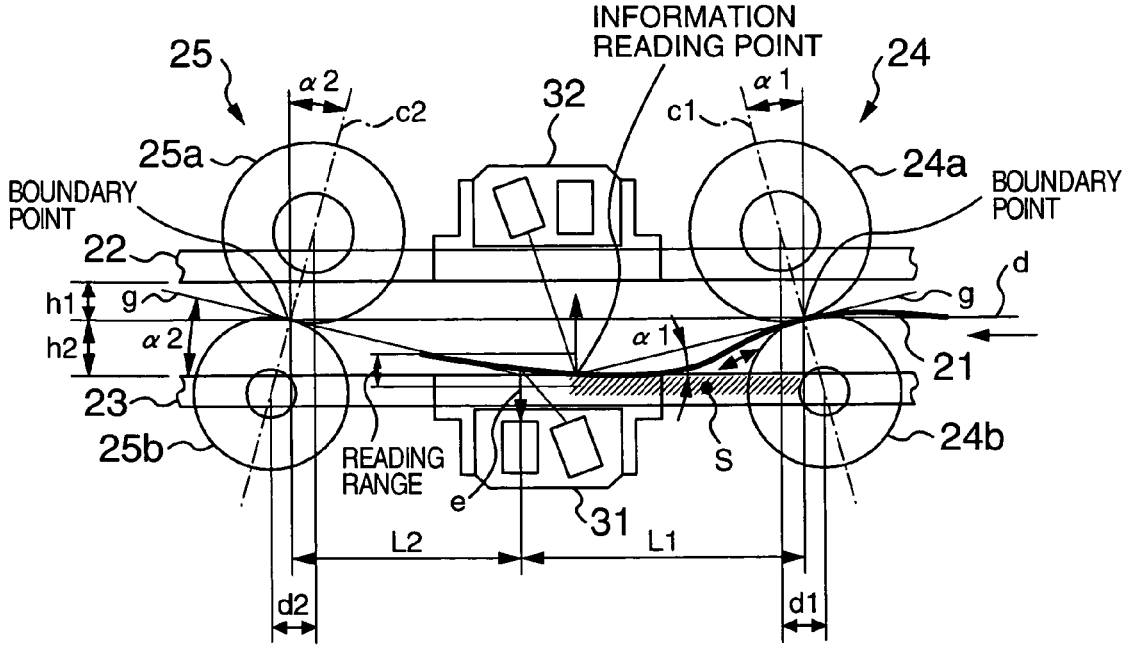
FIG. 4 is a schematic view of a discriminating part of the invention.

In order to keep a distance between the information obtaining device and the paper money constant, a structure as shown in FIG. 4 is used.

FIG. 4 is a view showing a transfer passage structure of the checking device 6 including an embodiment of the invention.

In FIG. 4, clamping direction lines c1 and c2 are inclined by respective inclination angles $\alpha 1$ and $\alpha 2$ so that the inclination angles are inversed with respect to each other as seen from a side. Therefore, the paper sheet or the like 21 is transferred toward the second guide menans 23. When the angle $\alpha 1$ is not less than a predetermined angle, the paper money 21 reaches the second guide device 23 before reaching the first information obtaining device 31 in a region S (as the claimed sheet supporting surface area) of the second guide device 23 between the first transfer device 24 and the first information obtaining device 31. Therefore, the distance between the information obtaining device 31 and the paper money 21 can be kept constant.

That is, when a distance between the second information obtaining device 32 and each of the drive rollers 24*a* and 25*a* is smaller than a distance between the first information obtaining device 31 and corresponding one of the driven rollers 24*b* and 25*b*, the paper money 21 is transferred along the second guide device 23 at a side of the first information obtaining device 31.

Alternatively, when a distance between the first information obtaining device 31 and each of the driven rollers 24*b* and 25*b* is smaller than a distance between the second information obtaining device 32 and corresponding one of the drive rollers 24*a* and 25*a*, the paper money 21 is transferred along the first guide device 22 at a side of the second information obtaining device 32.

When a transfer face d is substantially straight as shown in FIG. 4, the predetermined angle of the angle $\alpha$ is obtained from the following formula with L being a distance between a clamping point of the transfer device and a detecting position of the information obtaining device in a transfer direction, and h being a distance between the clamping point of the transfer device and the guide device at the detecting position of the information obtaining device in a direction perpendicular to the transfer direction, $$\alpha \geqq \tan^{-1}(h/L). \quad \text{(formula 1)}$$

In FIG. 4, the angle $\alpha 1$ is represented by a formula 2. Incidentally, L1 is a distance between the clamping point of the first transfer device 24 and the detecting point of the first information obtaining device 31 in the transfer direction, and h2 is a distance between the clamping point of the first transfer device 24 and the second guide device 23 at the detecting position of the first information obtaining device 31 in the direction perpendicular to the transfer direction, $$\alpha 1 \geqq \tan^{-1}(h2/L1). \quad \text{(formula 2)}$$

Similarly, the angle $\alpha 2$ is represented by a formula 3. Incidentally, L2 is a distance between the clamping point of the second transfer device 24 and the detecting position of the first information obtaining device 31 in the transfer direction, $$\alpha 2 \geqq \tan^{-1}(h2/L2). \quad \text{(formula 3)}$$

If the angle $\alpha$ is excessively great, a frictional force between the paper sheet or the like 21 and the second guide device 23 becomes great so that a transfer trouble such as jam can occur. Therefore, when a frictional coefficient between the paper sheet or the like 21 and the second guide device 23 is $\mu pg$, the angle $\alpha$ is set in a range of $$\alpha < \tan^{-1}(1/\mu_{pg}). \quad \text{(formula 4)}$$

Figure 5:
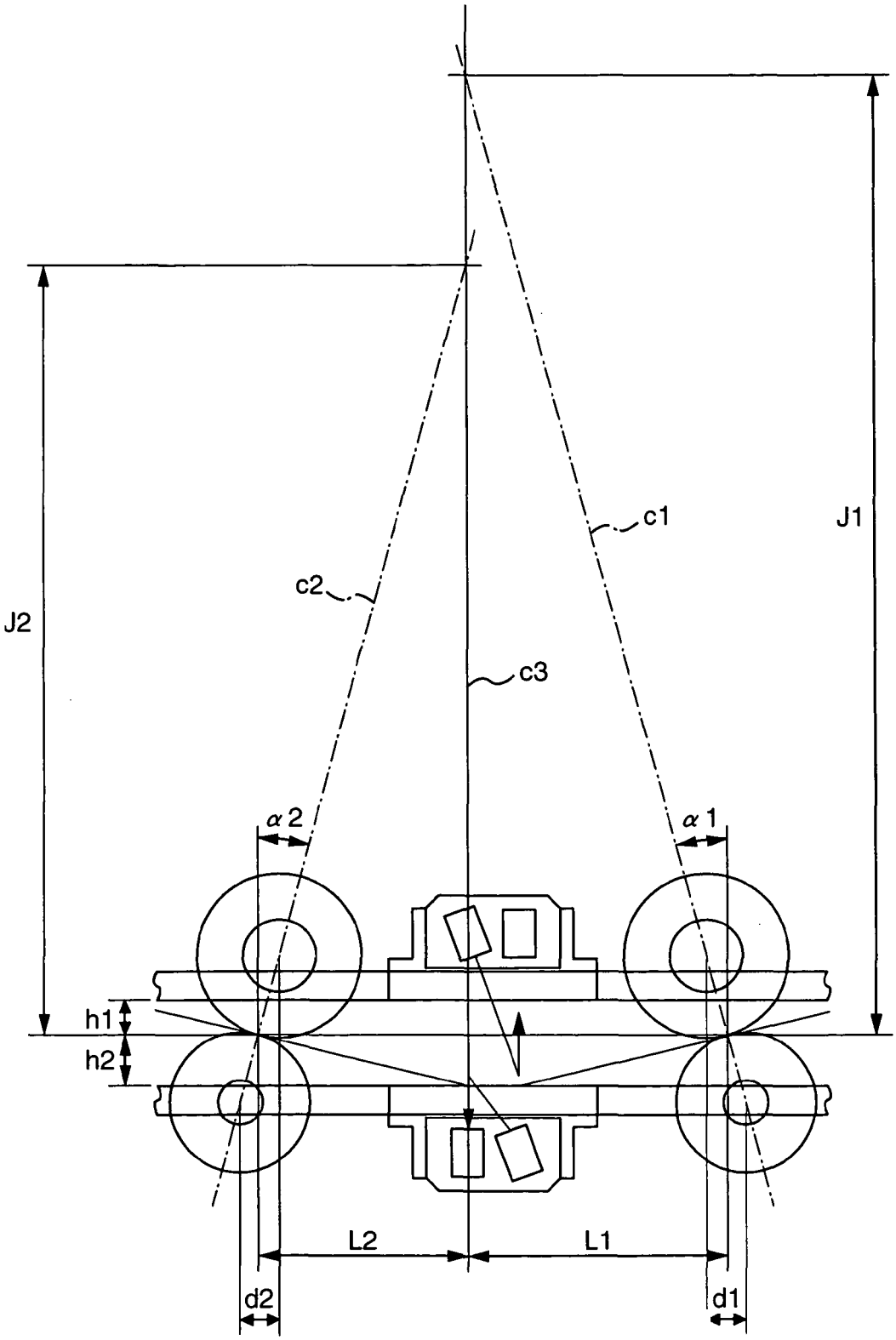
FIG. 5 is a schematic view of a discriminating part of the invention.

Further, as shown in FIG. 5, a line c3 passing the information obtaining position of the first information obtaining device 31 perpendicular to the transfer face d may intersects the clamping direction line c1 or c2.

A distance J between the transfer face d and the intersecting point is represented by $$J < L^2/h \quad \text{(formula 5)}$$

When the angle $\alpha$ is excessively great, the transfer trouble can occur as stated above, therefore, it should be limited in a range represented by the formula 4.

Figure 6:
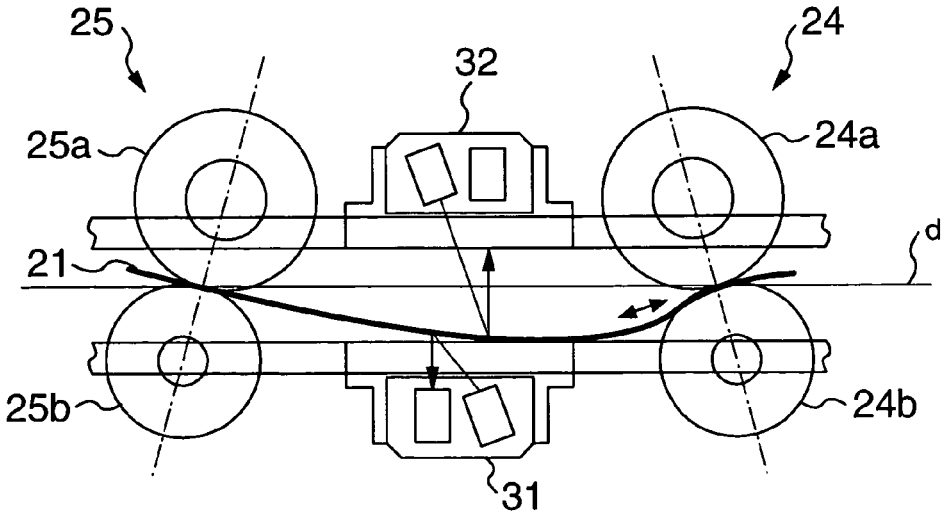
FIG. 6 is a schematic view of a discriminating part of the invention.

Incidentally, it is important for the clamping line c2 of the second transfer device 25 to be inclined, because as shown in FIG. 6, after the transferred paper money 21 is clamped by the second transfer device 25, a force pressing the paper money 21 against the first information obtaining device 31 is generated.

Figure 7:
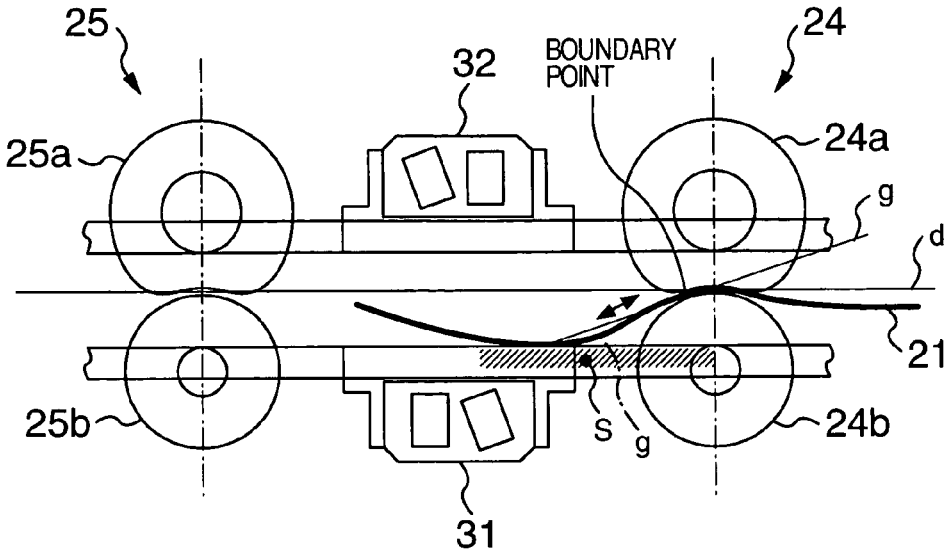
FIG. 7 is a schematic view of a discriminating part of the invention.

Further, although the clamping line c is inclined in the above embodiments, an embodiment as shown in FIG. 7 may be used.

In FIG. 7, one of the rollers of each of the first and second transfer device 24 and 25 is softened in comparison with the other one thereof so that a transfer direction line g (as the claimed tangential line of the boundary point of the transfer surface of the sheet transfer member from which boundary point the one of the sheets starts to separate away from the transfer surface) of the paper sheet or the like is directed to the region S.

Figure 8:
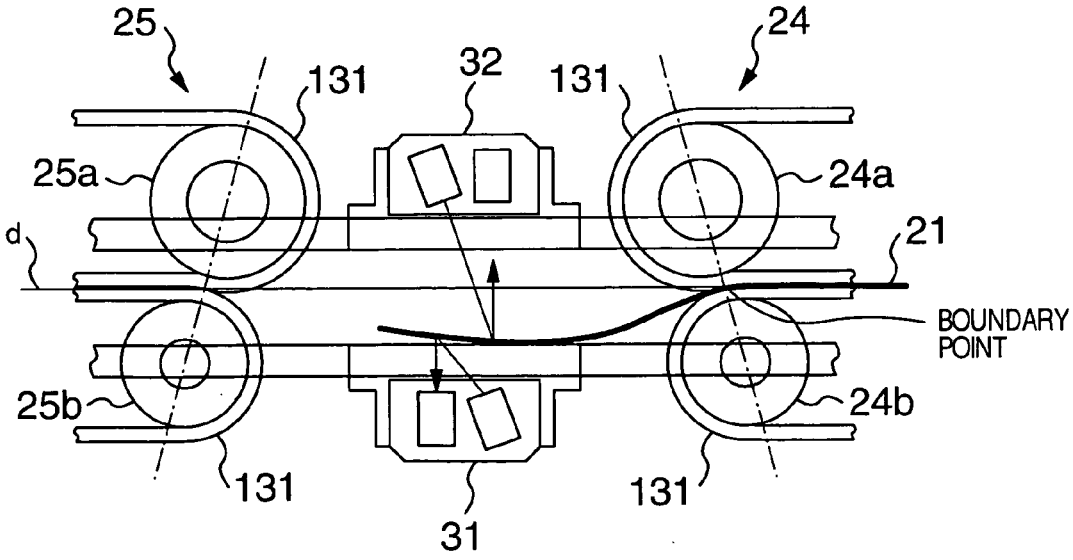
FIG. 8 is a schematic view of a discriminating part of the invention.
Figure 9:
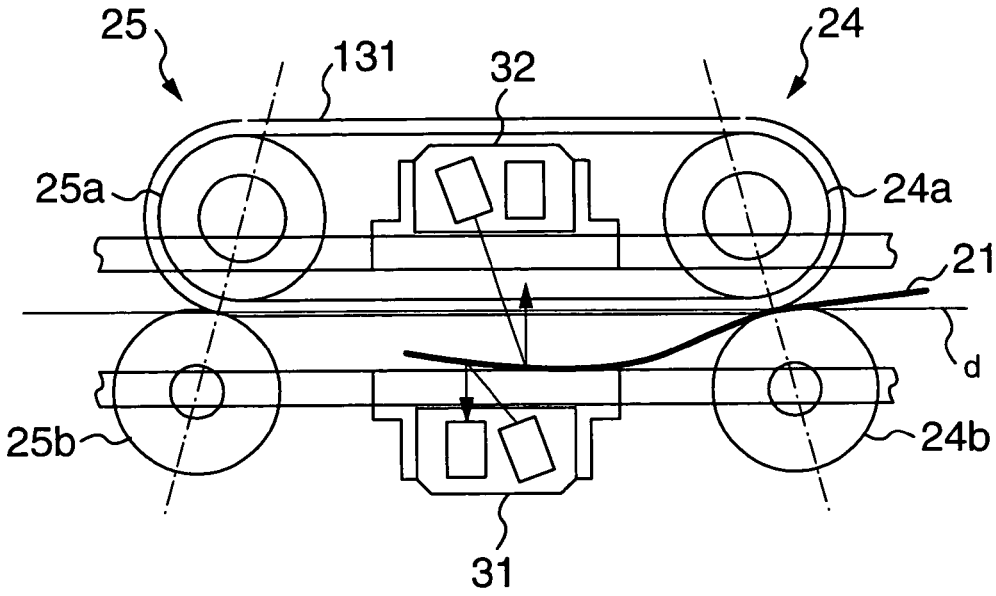
FIG. 9 is a schematic view of a discriminating part of the invention.

Further, although the first and second transfer device 24 and 25 has respective pairs of the rollers in the above embodiments, the paper money 21 may be transferred by belts 131 as shown in FIGS. 8 and 9. In these arrangement, the angles $\alpha 1$ and $\alpha 2$ of the clamping direction lines c1 and c2 of the first and second transfer device 24 and 25 at a position closes to the first information obtaining device 31 have relationships represented by the above formula 1.

As described above, by inclining the clamping direction lines at both sides close to the information obtaining device from the direction perpendicular to the transfer direction to be inversed with respect to each other, the paper money is pressed against one of the guide device to keep the distance between the information obtaining device and the paper money constant.

Incidentally, when the first and second guide device 22 and 23 are formed of a high resistance material such as plastics, a contact with the paper money generates a static electricity. Therefore, dust is attracted by the static electricity to have an adverse affect on obtaining the information.

Therefore, the first and second guide device 22 and 23 are preferably formed of a relatively low volume resistivity (not more than $10^{12}$ Ωm) and optically transparent material.

Further, since a cost increases when the whole of the first and second guide device 22 and 23 is formed of such material, a guide member 123 of the relatively low volume resistivity (not more than $10^{12}$ Ωm) and optical transparence is preferably arranged at the detecting positions of the first and second information obtaining device 31 and 32, and an electrically grounded electrically conductive member 124 preferably contacts it, as shown in FIG. 4.

Therefore, the dust is prevented from being attracted to the detecting position.

Figure 10:
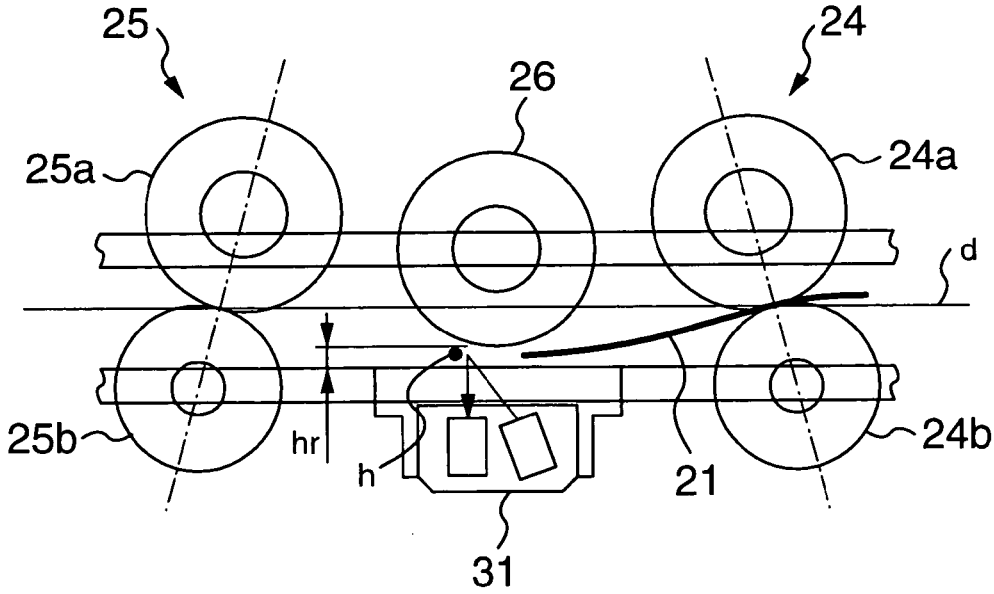
FIG. 10 is a schematic view of a discriminating part of the invention.

Further, these structures may be applied to a case in which a movable guide device 26 is used as shown in FIG. 10, so that a good effect is obtained. When the information obtaining device such as a magnetic information obtaining device or an information obtaining device for obtaining an optical information on only one side is arranged at one side of the transfer clearance, the movable guide device 26 is arranged to be opposed to the information obtaining device.

As stated above, the clamping direction lines is inclined to transfer the paper money 21 at a position close to the third information obtaining device 33, and to introduce smoothly the paper money 21 to a clearance h between the movable guide device 26 and the second information obtaining device 23.

Further, even when the paper money 21 has an excessive crease so that the paper money 21 generates a force to be separated from the second guide device 23, the movable guide device 26 keeps the paper money 21 within a distance tr from the second guide device.

Therefore, a distance between the information obtaining device and the paper money can be kept constant.

Figure 11:
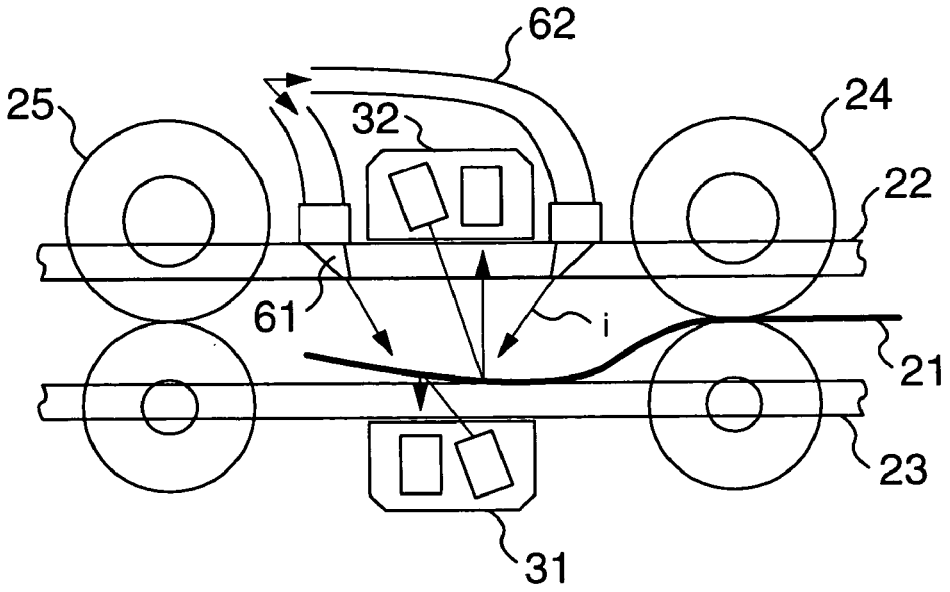
FIG. 11 is a schematic view of a discriminating part of the invention.

Further, as a structure having the similar effect, an air flow device as shown in FIG. 11 is usable.

A nozzle 61 (as the claimed pneumatic blower) is arranged on the first guide device 22 opposed to the first information obtaining device 31, and an air is supplied thereto through a supply tube 62 by a blower not shown, so that the air buffets the paper money 21 as an arrow i. Therefore, the transferred paper money 21 is pressed against the second guide device 22 to keep the distance between the paper money 21 and the first or second information obtaining device 31 or 32 constant.

Figure 12:
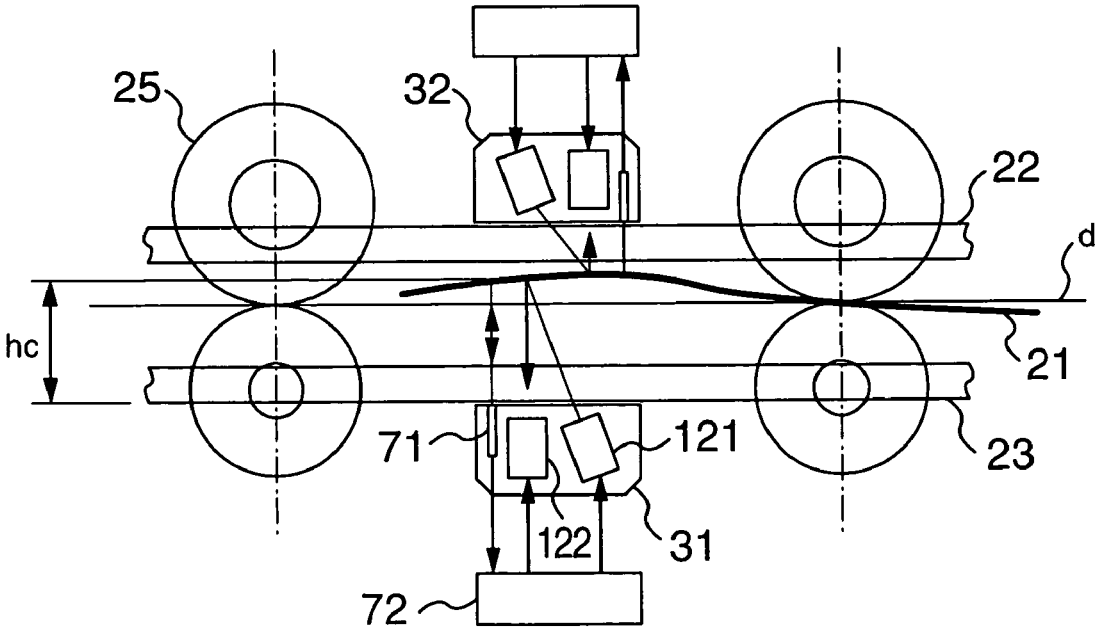
FIG. 12 is a schematic view of a discriminating part of the invention.

As shown in FIG. 12, a distance hc between the paper money 21 and the first or second information obtaining device 31 or 32 may be measured to control a light emitter element 121 and a light receiver element 122 as the claimed information reader.

In FIG. 12, a distance measuring device 71 in which the distance is measured from a reflection time period of ultrasonic wave or by a triangular surveying of positions irradiated by laser measures the distance hc from the paper money 21.

A control device 72 receives the distance hc from the distance measuring device 71 to control the light emitter element 121 and the light receiver element 122.

A light projected by the light emitter element 121 has a highest brightness at an light beam axis center, and a brightness decreasing from the center toward an outside. When a standard is set in a case that the paper money passes on the transfer surface d, the brightness at a coverage part of the paper money 21 detected by the light receiver element 122 decreases in accordance with an increase in distance from the transfer surface d.

In a control, an electric current into the light emitter element 121 is adjusted in accordance with the distance hc to change a light intensity. A predetermined relationship between the distance hc and the electric current is incorporated preliminarily in the control device 72. Therefore, the brightness on the coverage part of the paper money 21 is kept constant so that the brightness does not change over the paper money 21.

By the above mentioned structures, the distance between the paper money and the information obtaining device is kept constant to obtain correctly the information so that a significantly high reliability on detecting a kind of the paper money and checking a bad paper can be performed.

Figure 13:
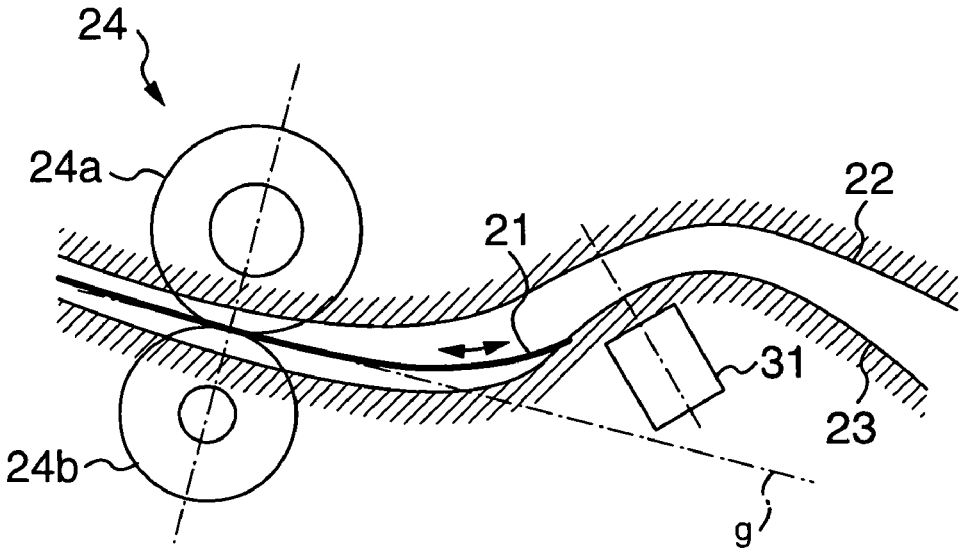
FIG. 13 is a schematic cross sectional view showing another embodiment of the invention.

As shown in FIG. 13, at least one of the first and second guide device 22 and 23 may be curved in such a manner that the paper sheet or the like 21 is smoothly guided to the detecting position and the transfer direction line g (tangential line of the boundary point of the transfer surface of at least one of the rollers 24*a* and 24*b* from which boundary point the paper sheet or the like 21 starts to separate away from the transfer surface) intersects the surface of the at least one of the first and second guide device 22 and 23 between the at least one of the first and second guide device 22 and 23 and the information obtaining device 31.

According to the invention, the distance between the paper money and the information obtaining device is kept constant to obtain correctly the information, so that a transfer device for paper sheet or the like with the high reliability on detecting the kind of the paper money and checking the bad paper can be provided.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An apparatus for handling sheets containing information thereon, comprising:

a movable sheet transfer member having a transfer surface which contacts a selected one of the sheets containing the information thereon so as to transfer the selected sheet along a transfer direction;

a sheet supporting surface area disposed so as to be contactable with the selected sheet which is being transferred;

an information reader arranged along the transfer direction of the selected sheet so as to face a surface of the selected sheet which is being transferred and delimiting an information reading range within which the information contained on the selected sheet is readable by the information reader, which information reading range includes an information reading point at which the information contained on the selected sheet is read from the selected sheet by the information reader;

wherein, as seen in a view direction which is perpendicular to both of a thickness direction and the transfer direction of the selected sheet, a tangential line, at a boundary point of the transfer surface of the sheet transfer member from which the selected sheet starts to separate from the transfer surface of the transfer member, extends in a side area of an imaginary straight line passing through the boundary point and the information reading point so as to intersect the sheet supporting surface area at a position between the boundary point and a furthest extent of the information reading range from the boundary point;

wherein the boundary point corresponds to a point at which the sheet transfer member contacts the selected sheet; and wherein the boundary point and the sheet supporting surface area are spaced from each other in a direction perpendicular to the imaginary straight line, and the selected sheet is pressed against the sheet supporting area at a position between the boundary point and the information reading range.

2. An apparatus according to claim 1, wherein the sheet supporting surface area extends to guide therealong to the information reading range the selected sheet.

3. An apparatus according to claim 1, further comprising:

a supplemental movable sheet transfer member having a supplemental transfer surface diagnosed in opposition to the movable transfer member which contacts the selected sheet to facilitate transfer of the selected sheet, and first and second press members respectively opposing the sheet transfer member and supplemental sheet transfer member such that the selected sheet is pressed between the sheet transfer member and the first press member in a first press direction and between the supplemental sheet transfer member and the second press member in a second press direction.

4. An apparatus according to claim 1, wherein the sheet transfer member is a roller rotatable on an rotational axis.

5. An apparatus according to claim 1, wherein the sheet transfer member is a belt rotatable along an annular course.

6. An apparatus according to claim 1, wherein the information reader includes a pair of input points opposed to each other in such a manner that the input points face to respective sides of the selected sheet in a thickness direction to read the information contained on the selected sheet through the input points.

7. An apparatus according to claim 1, further comprising a supplemental movable sheet transfer member having a supplemental transfer surface diagnosed in opposition to the movable transfer member which contacts the selected sheet to facilitate transfer of the selected sheet.

8. An apparatus according to claim 1, wherein when viewed from a direction perpendicular to a thickness direction and a transferred direction of the selected sheet such that the sheet supporting surface area would be extendable in a direction parallel to a support line direction which passes the information reading range, the relations of $\alpha > \tan^{-1}(h/L)$ and $\alpha < \tan(1/\mu pg)$ are satisfied where:

$\alpha$ is an inclination angle between the support line direction and the tangential line at the boundary point of the transfer surface of the sheet transfer member, L is a distance between the boundary point of the transfer surface of the sheet transfer member and the information reading point in the support line direction, h is a distance between the boundary point of the transfer surface of the sheet transfer member and the sheet supporting surface area in a direction perpendicular to the support line direction, and $\mu pg$ is a frictional coefficient between the selected sheet and the transfer surface of the sheet transfer member.

9. An apparatus according to claim 1, further comprising a supplemental sheet supporting surface area opposed to the sheet supporting surface and contactable with the one of the sheets, said supplemental sheet supporting surface area being movable with respect to the sheet supporting surface area such that the selected sheet is urged in a direction toward the sheet supporting surface area.

10. An apparatus according to claim 9, wherein the supplemental sheet supporting surface area is opposed to the information reading range so that the selected sheet is urged in a direction toward the information reading range.

11. An apparatus according to claim 1, further comprising a supplemental sheet supporting surface area opposing the sheet supporting surface area and contactable with the selected sheet, said supplemental sheet supporting surface area extending in such a manner that the selected sheet is guided toward the sheet supporting surface area.

12. An apparatus according to claim 1, wherein the sheet supporting surface area is curved.

13. The apparatus according to claim 1, wherein:

the sheet transfer member includes a drive roller and a driven roller mounted along a clamping direction line;

$\alpha$ is an inclination angle between a support line direction and a tangential line of a boundary point of the transfer surface of the sheet transfer member from which boundary point the selected sheet starts to separate away from the transfer surface;

the clamping direction line is inclined by the angle $\alpha$ causing an offset between the drive roller and the driven roller.

14. The apparatus according to claim 1, wherein the information contained on the selected sheet is readable in the information reading range.

15. The apparatus according to claim 1, wherein the apparatus forms a part of an automated teller machine and the sheets containing information thereon are paper money from which information thereon is read by the information reader.

16. An apparatus for handling sheets containing information thereon, comprising:

a movable sheet transfer roller having a transfer surface for contacting a selected one of the sheets containing the information thereon and transferring the selected sheet along a transfer direction;

a sheet supporting surface area for contacting the selected sheet which is being transferred;

an information reader arranged along the transfer direction to face a surface of the selected sheet which is being transferred, and delimiting an information reading range within which the information contained on the selected sheet is readable from the selected sheet by the information reader, the information reading range including an information reading point at which the information contained on the selected sheet is read;

a press roller opposing the sheet transfer roller such that the selected sheet can be pressed between the sheet transfer roller and the press roller at a boundary point on the selected sheet in a press direction, wherein an imaginary straight line passing the boundary point in a direction perpendicular to the press direction intersects the sheet supporting surface area as seen in a view direction perpendicular to a thickness direction and the transfer direction of the selected sheet, and wherein the pressing direction is parallel to another imaginary straight passing the center of the sheet transfer roller and the center of the press roller.

17. An apparatus according to claim 1, further comprising:

a press member opposing the sheet transfer member for pressing the selected sheet between the sheet transfer member and the press member, said press member including a press surface for contacting the selected sheet and pressing the selected sheet between the press surface and the transfer surface, wherein a compression resistance surface rigidity of one of the press and transfer surfaces is different from that of the other.

18. The apparatus according to claim 16, wherein the information contained on the selected sheet is readable from the information reading range.

19. An apparatus for handling sheets containing information thereon, comprising:

a movable sheet transfer member being including a transfer surface for contacting a selected one of the sheets and transferring the selected sheet along a transfer direction;

a sheet supporting surface area for contacting the selected sheet;

an information reader arranged along the transfer direction so as to face a surface of the selected sheet and delimiting an information reading range within which the information contained on the selected sheet is readable from the selected sheet by the information reader, the information reading range including an information reading point at which the information is read;

a distance detector facing the selected sheet for measuring a value changing in accordance with a change in distance between the selected sheet and the information reader;

wherein the information reader includes a light emitter for projecting a light to the selected sheet and a light receiver for receiving the light reflected by the selected sheet to read the information contained on the selected sheet from the selected sheet, and wherein the light emitter is controlled in accordance with the value such that an intensity of the light emitted by the light emitter is increased in accordance with the increase of distance between the one of the sheets and the information reader.

* * * * *